US008915256B2

(12) United States Patent
Klava

(10) Patent No.: US 8,915,256 B2
(45) Date of Patent: Dec. 23, 2014

(54) COMBINED DEVICE FOR TREATING HAIR

(71) Applicant: Hairostraight, SIA, Aizkraukle (LV)

(72) Inventor: Juris Klava, Valodzes (LV)

(73) Assignee: Hairostraight, SIA, Aizkraukle (LV)

( * ) Notice: Subject to any disclaimer, the term of this patent is extended or adjusted under 35 U.S.C. 154(b) by 0 days.

(21) Appl. No.: 13/791,771

(22) Filed: Mar. 8, 2013

(65) Prior Publication Data

US 2013/0186422 A1 Jul. 25, 2013

Related U.S. Application Data

(63) Continuation of application No. PCT/LV2011/000005, filed on Mar. 18, 2011.

(30) Foreign Application Priority Data

Sep. 10, 2010 (LV) ..... P-10-129

(51) Int. Cl.

| | |
|---|---|
| ***A45D 2/40*** | (2006.01) |
| ***A45D 2/36*** | (2006.01) |
| ***A45D 20/10*** | (2006.01) |
| ***A46B 15/00*** | (2006.01) |

(52) U.S. Cl.

CPC *A45D 2/36* (2013.01); *A45D 20/10* (2013.01); *A46B 15/0055* (2013.01); *A46B 2200/104* (2013.01)

USPC ..... 132/224

(58) Field of Classification Search

USPC ..... 132/224, 229; 34/96–101

See application file for complete search history.

(56) References Cited

U.S. PATENT DOCUMENTS

| | | | | |
|---|---|---|---|---|
| 5,584,307 | A * | 12/1996 | Bauer et al. | 132/113 |
| 5,865,188 | A | 2/1999 | Marquez | |
| 6,070,596 | A * | 6/2000 | Altamore | 132/224 |
| 8,567,414 | B2 * | 10/2013 | Rivola | 132/224 |
| 2002/0100488 | A1 * | 8/2002 | Taylor et al. | 132/271 |
| 2005/0039770 | A1 | 2/2005 | Djulbegovic | |
| 2006/0191554 | A1 * | 8/2006 | Lafuente | 132/224 |
| 2009/0126757 | A1 | 5/2009 | Marino et al. | |
| 2010/0089413 | A1 | 4/2010 | Wright et al. | |

FOREIGN PATENT DOCUMENTS

| | | | |
|---|---|---|---|
| EP | 1342427 | A1 | 10/2003 |
| JP | 2003125836 | A | 5/2003 |

OTHER PUBLICATIONS

European Patent Office, "International Search Report and Written Opinion of the International Searching Authority" for PCT International application No. PCT/LV2011/000005 having International filing date Mar. 18, 2011, EPO, Rijswijk, Netherlands, Jun. 1, 2011.

* cited by examiner

*Primary Examiner* — Rachel Steitz

(74) *Attorney, Agent, or Firm* — Law Office of Andrei D Popovici, PC

(57) ABSTRACT

The present invention relates to a combined device for treating the hair, which secures simultaneous hair drying, straightening, smoothing and styling with minimum damage to the structure of the hair. A combined device for treating the hair contains a dryer part A and a styling (straightener) part B. The hot or warm air from the part A flows onto the part B, which comprises hairbrushes (5, 6) of variable profile. Drying and styling or straightening is performed by the part B. The device causes minimum damage to the structure of the hair.

20 Claims, 3 Drawing Sheets

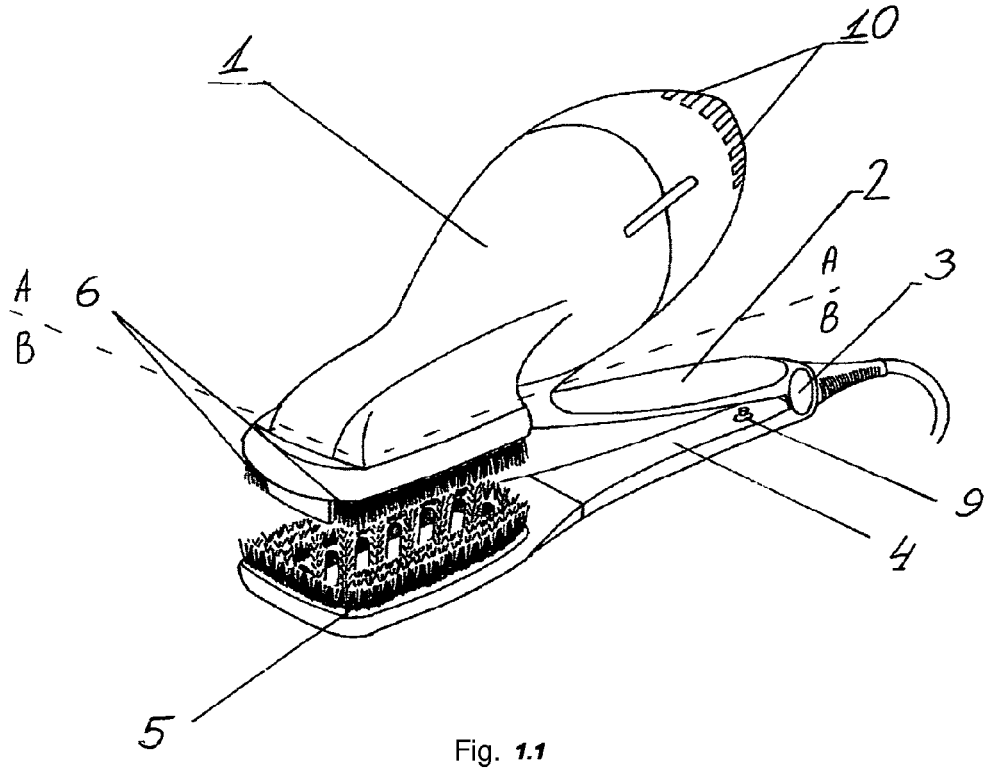
Fig. 1.1
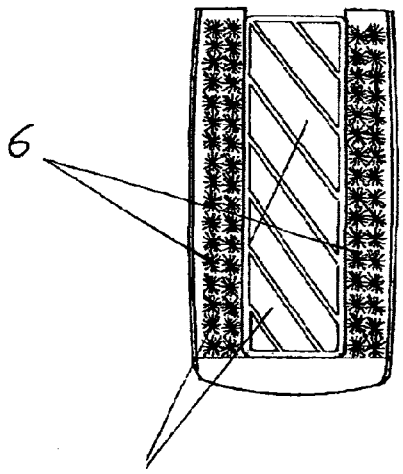
Fig. 1.2
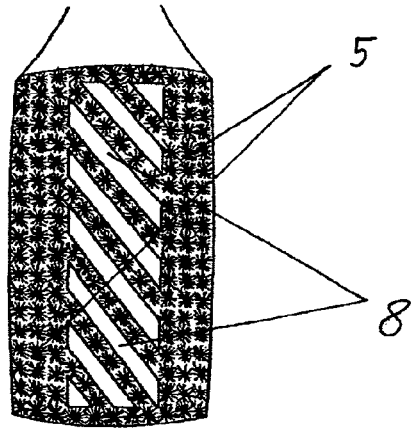
Fig. 1.3

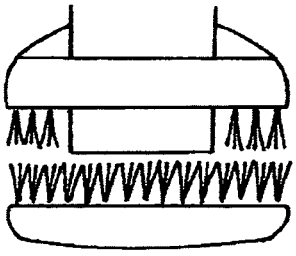
Fig. 2.1.a
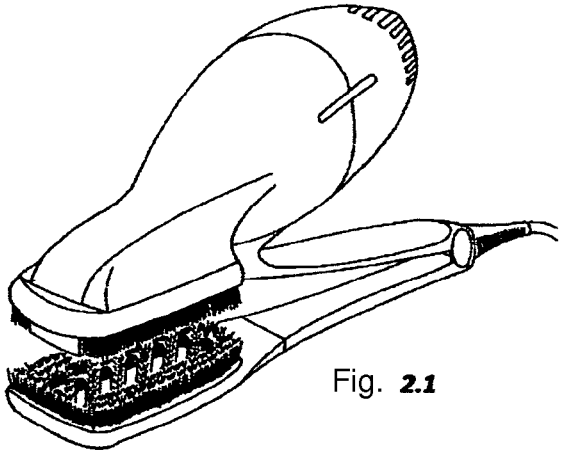
Fig. 2.1
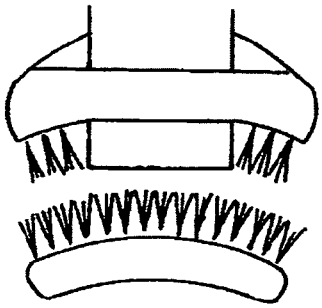
Fig. 2.2.b
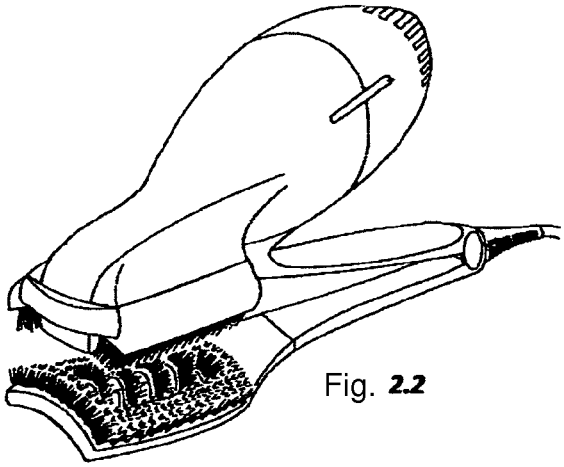
Fig. 2.2
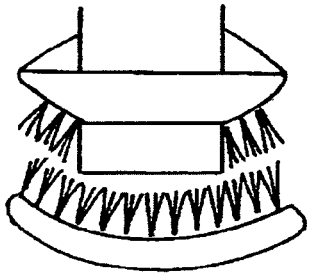
Fig. 2.3.c
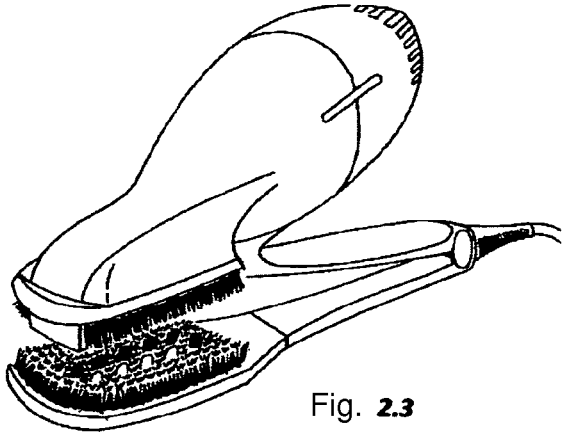
Fig. 2.3

COMBINED DEVICE FOR TREATING HAIR

RELATED APPLICATION DATA

This application is a continuation of PCT International Application No. PCT/LV20111/000005, having an international filing date of Mar. 18, 2011, which claims priority from Latvian Patent Application No. P-10-129, filed Sep. 10, 2010, both of which are herein incorporated by reference.

SUMMARY

The present invention relates to a combined device for treating the hair, which secures simultaneous hair drying, straightening, smoothing and styling with minimum damage to the structure of the hair.

Various hair dryer models are known (PHILIPS, BRAUN, BABYLISS, REMINGTON), which basically perform a hair drying function—through the body of the dryer under the action of a fan the air is blown though a heating element and the heated air is used for drying the hair. Hair irons (PHILIPS, BRAUN, BABYLISS, REMINGTON) are known, which are meant for straightening a structure of dry hair—the hair is fixed between two heated surfaces and straightened as a result of heat treating. Combined devices for hair straightening and drying according to U.S.2010089413 and JP2003125836A are known, the functional principle of which is similar to that of the hair iron, but in contrast to the common hair irons such as device can be used also for a wet hair, as it is supplied with a blow dryer or a fan, which blows the air through perforated heated surfaces, thus facilitating the hair drying process. A combined hair drying and styling device according to U.S.2005039770A1 is known, which combines a hair dryer and a round rotating hairbrush, which provides for simultaneously drying and styling the hair. A two-arm hair straightening brush according to U.S. Pat. No. 5,865,188A is known, in which the hair is placed, squeezed between hair brushes and treated by a common hair dryer to dry the hair in a fixed position.

Drawbacks of these known hair dryers consist in that, in order to style, straighten, and smoothen the hair without drying it, additional instruments (various hairbrushes) are required, and in that existing special hair dryer nozzles for hair styling, straightening or smoothening achieve the desired effect only partially. A drawback of the known hair irons or flat irons is that a strong thermal influence on the already dry hair damages it a lot and a hair iron shall be used when the hair is dried with a hair dryer, which means that this process is time consuming and complicated. Drawbacks of the above-mentioned combined devices for hair straightening and drying according to U.S.2010089413 and JP2003125836A consist in that by combining this hair iron with a fan or a blow dryer, the power of the dryer is limited due to its size (it is impossible to build in an electric motor with enough power) and the construction thereof does not have enough air outflow, or the air does not have enough space (as the air encounters the opposite arm) and in a significant detrimental effect rendered by a heated surface on the hair. A drawback of the combined hair drying/styling device according to U.S.2005039770A1 is that the dryer's air blowing-out opening is located at a distance from a rotating hairbrush and the air flow reaches the surface to be styled being diffused, that means that the hair beyond the zone of the rotating brush is also dried (the efficiency of the process is decreased and the hair may tangle and wrap over the rotating hairbrush), moreover, due to the distance, the blown-out air loses heat, besides, the principle of the rotating brush involves a great risk that in case of careless use of the device the hair can get into the hairbrush and wrap over the axis of the rotating mechanism. A drawback of the two-arm brush for straightening the hair according to U.S. Pat. No. 5,865,188A is that, in order to use the device, a hair dryer is required, by which the warm air is blown onto a straightening brush, thus performing hair straightening and ironing.

The combined device according to the invention, likewise the known hair dryer and the combined devices according to U.S.2010089413, JP2003125836A and U.S.2005039770A1, has a dryer's part with a body, an electric motor, a fan and a heating element, hair squeezing arms like those of the known hair iron, of the known hair straightening brush according to U.S. Pat. No. 5,865,188A and of the known combined devices according to U.S.2010089413 and JP2003125836A, hair straightening brushes built into the arms like those of the known hair straightening brush according to U.S. Pat. No. 5,865,188A. The combined hair-treating device according to the invention simultaneously dries, straightens, smoothens and styles the hair; therefore, a more effective result is achieved with a single device, than with the known devices, and the device according to the invention does not damage hair as much as the known hair irons and the known combined devices according to U.S.2010089413 and JP2003125836A. The main functional effect of the combined device according to the invention is ensured by the straightening hairbrushes, between which the hair lock is squeezed and in which a dryer's blowing out air opening is integrated; thus, the warm air reaches exactly the zone to be dried, straightened, smoothened, and styled, which ensures maximum process control and efficiency and excludes undesirable side effects (such as hair fluffing, hair tangling and structure damaging) and the hair reaches warm air application zone untangled and with naturally and optimally smoothened hair scales. In a combined device for treating the hair, which contains a dryer part and styling part, according to the present invention, the dryer part and the styling par are interconnected, wherein a top arm of the dryer at the end opposite to an air blowing out opening is connected to a bottom arm through a hinge element, and the end of the top arm of the dryer contains a hairbrush, and the free end of the bottom arm contains a hairbrush. In at least some embodiments:

The hairbrush of the top arm is symmetrically foldable with the hairbrush of the bottom arm.

The air blowing out opening of the dryer in the inner part of the hairbrush of the top arm is made of heat resistant plastic.

The inner part of the hairbrush of the bottom arm has an air outflow opening, located opposite to the air blowing out opening of the top arm.

The hairbrush portion of the bottom arm is made of a heat resistant plastic.

The hairbrush of the top arm may be convex relative to the top arm and the hairbrush portion of the top arm may be concave relative to the bottom arm.

The hairbrush portion of the bottom arm may be concave relative to the top arm and the hairbrush portion of the top arm may be convex relative to the bottom arm.

The hairbrush portion of the bottom arm may be straight relative to the top arm and the hairbrush portion of the top arm may be straight relative to the bottom arm.

The air-intake end of the dryer may be connected to the bottom arm through a hinge element.

Between the arms there may be a spring capable of moving them away from each other.

Between the dryer and the bottom arm there may be a spring capable of moving them away from each other.

Between the arms there may be an electric current switch.

Between the dryer and the bottom arm there may be an electric current switch.

The hairbrushes may be replaceable.

The combined device for treating the hair may be used for hair drying.

The combined device for treating the hair may be used for hair straightening.

The combined device for treating the hair may be used for hair smoothening.

The combined device for treating the hair may be used for hair styling.

BRIEF DESCRIPTION OF THE DRAWINGS

The device according to the invention is illustrated in the drawings:

FIG. 1.1 shows a general view of the device.

FIG. 1.2 shows a plan view of the bottom arm of the hairbrush.

FIG. 1.3 shows a plan view of the top arm of the hairbrush.

FIGS. 2.1, 2.2, and 2.3 show general views of the variants of the arm hairbrush.

FIGS. 2.1*a*, 2.2*b*, and 2.3*c* show front views of the variants of the arm hairbrush.

DETAILED DESCRIPTION OF PREFERRED EMBODIMENTS

Figure 3:
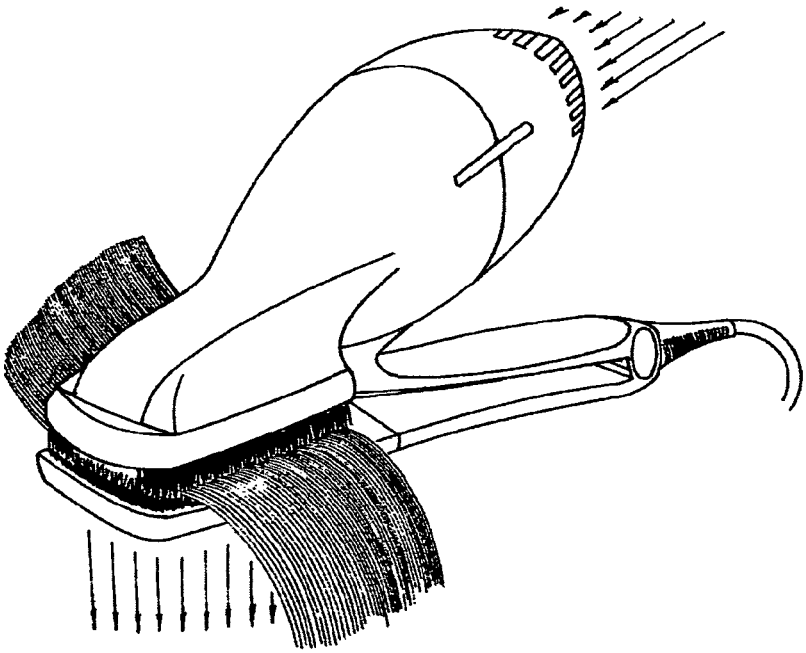
FIG. 3 shows the device in function.

The combined device for treating the hair contains a dryer part A and a styling part B which are interconnected. The combined device for treating the hair contains a dryer 1 having an electric motor, a fan, a heating element, and a body, which is either fixed to a top arm 2, or is formed as an integral part of the top arm 2. Close to an air blowing out opening 7 of the dryer 1 and at the end of the top arm 2 of the dryer 1 there is a hairbrush 6 with a bristle on the both longer sides of the air blowing out opening 7 of the dryer 1. In turn, the top arm 2 of the dryer 1 at the opposite end is connected to a bottom arm 4 through a hinge element 3, on the opposite end of which there being a hairbrush 5.

In the inner part of the hairbrush 5 there is an air outflow opening 8 located opposite to the blowing out opening 7 of the dryer 1. The hinge element 3 of the top arm 2 and the bottom arm 4 has a spring mechanism, capable of moving the end of the top arm 2 of the dryer 1 away from the free end of the bottom arm 4. Between the arms 2 and 4 there is an electrical switch 9, capable of actuating the device when the arms 2 and 4 are folded. The air blowing out opening 7 portion of the dryer 1 and the hairbrush 5 portion of the bottom arm 4 can be made of a high heat resistant plastic. The shape of the hairbrushes 5 and 6 of the device can be concave (FIGS. 2.3 and 2.3*c*) when desirable to style the hair ends outwards, convex (FIGS. 2.2 and 2.2*b*) when desirable to style the hair ends inwards, and straight (FIGS. 2.1 and 2.1*a*) when desirable to style the hair straight. The angle of the dryer's 1 position relative to the end of the hinge element 3 of the top arm 2 can range up to 180°, the device shown at FIGS. 1, 2, and 3 has an angle of approximately 45°, but the device shown at FIG. 4 has an angle of 0°. In the embodiment shown in FIG. 4, the body of the dryer 1 at the air intake end is fixed with the hinge element 3 to the bottom arm 4, wherein the dryer 1 of this embodiment of the device serves as the top arm 2.

Figure 4:
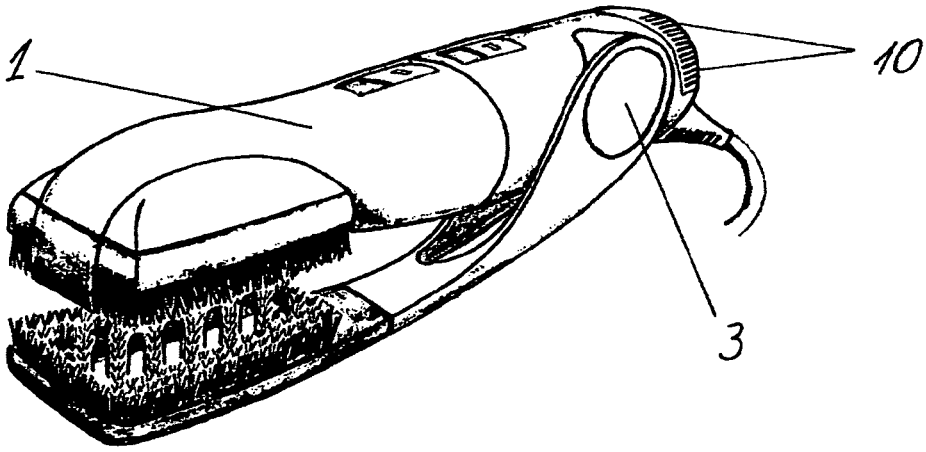
FIG. 4 shows another embodiment of the device, in which the dryer replaces the top arm.

The combined device for treating the hair operates in the following way:

A hair lock is placed between the hairbrushes 5 and 6 of the arms 2 and 4 of the device; by folding the arms 2 and 4 the hair is squeezed between the hairbrushes 5 and 6; the air blow of the dryer 1 is guided throughout the air blowing out opening 7 through the hair lock drying at the latter and released through the air outflow opening 8; during the drying process the device is directed from the scalp to the ends (FIG. 3).

As a result, during the drying process, the hair lock is fixed between the hairbrushes 6 and 5 of the arms 2 and 4 respectively and the hair structure is influenced during the drying process. Smaller or shorter hair is not separately blown away from the general lock of the basic hair giving the hair lock the effect of smoothness. The hair is squeezed between the bristle of the hairbrushes 5 and 6 and by directing them from the scalp to the ends the hair scales are hard strengthened (in a natural direction), which prevents overheating the hair (a greater amount of after-humidity remains in the hair, which also determines the level of hair damage or entirety).

Therefore, the combined device for treating the hair simultaneously conducts drying, straightening, smoothening and styling the hair, preventing damage to the hair structure. The device according to the invention combines the drying function with the principle of hair iron; therefore, those who has used hair irons will easily understand the principle of use.

As a great number of consumers have either naturally or intensively chemically or mechanically influenced fluffy or wavy hair or have hair that looks fluffy and damaged as the result of an incorrect hair care, the result provided by this device will be very in demand.

It will be clear to one skilled in the art that the above embodiments may be altered in many ways without departing from the scope of the invention. Accordingly, the scope of the invention should be determined by the following claims and their legal equivalents.

What is claimed is:

1. A combined device for treating hair, which contains a dryer part (A) and a styling part (B), wherein the dryer part (A) and the styling part (B) are interconnected, wherein a top arm (2) of a dryer (1) is connected to a bottom arm (4) through a hinge element (3), wherein an end of the top arm (2) of the dryer (1) contains a hairbrush (6), wherein a free end of the bottom arm (4) contains a hairbrush (5), wherein the top arm (2) comprises a plurality of mutually-parallel continuous air outlet strips for blowing out air, wherein the air outlet strips are laterally bounded by hairbrush bristles, and wherein an entire extent of each of the air outlet strips is oriented in a single generally-diagonal direction with respect to a rotation axis of the hinge element (3).

2. The device according to claim 1, wherein the hairbrush (6) of the top arm (2) is symmetrically foldable with the hairbrush (5) of the bottom arm (4).

3. The device according to claim 2, wherein the air outlet strips are formed by a heat resistant plastic.

4. The device according to claim 3, wherein an inner part of the hairbrush (5) of the bottom arm (4) has an air outflow opening (8) located opposite to the air outlet strips of the top arm (2).

5. The device according to claim 4, wherein the hairbrush (5) portion of the bottom arm (4) is made of a heat resistant plastic.

6. The device according to claim 4, wherein the air outflow opening (8) comprises a plurality of strips oriented parallel to the air outlet strips of the top arm (2).

7. The device according to claim 1, wherein the hairbrush (5) of the top arm (4) is convex relative to the top arm (2) and the hairbrush (6) portion of the top arm (2) is concave relative to the bottom arm (4).

8. The device according to claim 1, wherein the hairbrush (5) portion of the bottom arm (4) is concave relative to the top arm (2) and the hairbrush (6) portion of the top arm (2) is convex relative to the bottom arm (4).

9. The device according to claim 1, wherein the hairbrush (5) portion of the bottom arm (4) is straight relative to the top arm (2) and the hairbrush (6) portion of the top arm (2) is straight relative to the bottom arm (4).

10. The device according to claim 1, wherein an air-intake end of the dryer (1) is connected to the bottom arm (4) through the hinge element (3).

11. The device according to claim 1, wherein between the arms (2) and (4) there is a spring capable of moving them away from each other.

12. The device according to claim 1, wherein between the dryer (1) and the bottom arm (4) there is a spring capable of moving them away from each other.

13. The device according to claim 1, wherein between the arms (2) and (4) there is an electric current switch.

14. The device according to claim 1, wherein between the dryer (1) and the bottom arm (4) there is an electric current switch.

15. The device according to claim 1, wherein the hairbrushes (5) and (6) are replaceable.

16. The device according to claim 1, configured to be used for hair drying.

17. The device according to claim 1, configured to be used for hair straightening.

18. The device according to claim 1, configured to be used for hair smoothening.

19. The device according to claim 1, configured to be used for hair styling.

20. The device according to claim 1, wherein each of the air outlet strips extends substantially continuously across an air outlet surface of the top arm (2).

* * * * *